US005976277A

United States Patent [19]

Park et al.

[11] Patent Number: 5,976,277

[45] Date of Patent: Nov. 2, 1999

[54] HIGH SPEED TOOL STEEL, AND MANUFACTURING METHOD THEREFOR

[75] Inventors: Woo Jin Park; Eon Sik Lee; Sang Ho Ahn, all of Pohang, Rep. of Korea

[73] Assignees: Pohang Iron & Steel Co., Ltd.; Research Institute of Industrial Science & Technology, both of Rep. of Korea

[21] Appl. No.: 08/853,110

[22] Filed: May 8, 1997

[51] Int. Cl.[6] ..... B21J 1/00; C21D 5/00

[52] U.S. Cl. ..... 148/543; 148/544; 148/545; 148/546; 148/547; 164/46; 164/97; 164/461; 164/479

[58] Field of Search ..... 148/543, 544, 148/545, 546, 547; 164/46, 461, 97, 479

[56] References Cited

U.S. PATENT DOCUMENTS

| | | | |
|---|---|---|---|
| 4,194,900 | 3/1980 | Ide et al. | 75/251 |
| 5,343,926 | 9/1994 | Cheskis et al. | 164/64 |

FOREIGN PATENT DOCUMENTS

| | | |
|---|---|---|
| 48-020731 | 3/1973 | Japan . |
| 55-38961 | 3/1980 | Japan . |
| 63-199092 | 8/1988 | Japan . |
| 63-235092 | 9/1988 | Japan . |
| 647349 | 2/1979 | U.S.S.R. . |

OTHER PUBLICATIONS

Japanese Patent Laid–Open No. Sho 55–38961 Abstract, 1 p., (English language), Mar. 18,1980.

Korean Patent Laid–Open No. 96–21250 Abstract, 1 p.,(English language), Jul. 18, 1996.

*Primary Examiner*—Sikyin Ip

*Attorney, Agent, or Firm*—Webb Ziesenheim Logsdon Orkin & Hanson, P.C.

[57] ABSTRACT

A high speed tool steel and a manufacturing method therefor are disclosed, in which carbides are formed in the matrix in a uniform manner, thereby obtaining a high toughness and a high abrasion resistance. The high speed tool steel according to the present invention includes a basic composition of $W_aMo_bCr_cCo_dV_xC_yFe_z$ where the subscripts meet in weight %: $5.0\% \leqq a \leqq 7.0\%$, $4.0\% \leqq b \leqq 6.0\%$, $3.0\% \leqq c \leqq 5.0\%$, $6.5\% \leqq d \leqq 9.5\%$, $2.2\% \leqq x \leqq 8.3\%$, $1.1\% \leqq y \leqq 2.18\%$, and $66.52\% \leqq z \leqq 73.7\%$. The final structure has carbides uniformly distributed within a martensite matrix, which are mainly MC and $M_6C$ carbides. The method includes the steps of melting the above-defined alloy composition, gas spraying the melted alloy to form a bulk material, heat treating the bulk material to decompose the $M_2C$ carbides to stabilize $M_6C$ carbides and hot working the heat treated bulk material to a desired shape.

7 Claims, 5 Drawing Sheets

HIGH SPEED TOOL STEEL, AND MANUFACTURING METHOD THEREFOR

BACKGROUND OF THE INVENTION

1. Field of the Invention

The present invention relates to a method for manufacturing a high speed tool material for various tools. More specifically, the present invention relates to a high speed tool steel and a manufacturing method therefor, in which carbides are formed in the matrix in a uniform manner, thereby obtaining a high toughness and a high abrasion resistance.

2. Description of the Prior Art

Generally, a high speed tool steel is a high carbon alloy steel in which carbide forming elements are contained in large amounts. For example, one of them is W—Mo alloys, and others are W—Co alloys, Mo—Co alloys, and W—Mo—Co alloys.

If the high speed tool steel is to withstand against a high speed cutting operation, the abrasion resistance at a high temperature has to be superior, and the toughness has to be sufficient. Such mechanical properties of the high speed tool steel are decided by the size, shape, distribution of the carbides within the alloy. The carbides in high speed tool steels are classified by containing metallic elements MC, $M_6C$, $M_2C$, $M_{23}C_6$, and $M_7C_3$. MC is a carbide containing vanadium as the major ingredient. $M_{23}C_6$ is a carbide containing chrome as the major ingredient, and $M_6C$ and $M_2C$ are carbides containing tungsten and molybdenum as the major ingredients respectively. Specifically, if the mechanical properties such as abrasion resistance and toughness are to be superior, spherical carbides having a size of 2–3 $\mu$m should be uniformly distributed.

Further, the high speed tool steels which have a manufacturing history of more than 100 years show that their mechanical properties are varied in accordance with the manufacturing methods.

The method for manufacturing the high speed tool steels is classified into an ordinary casting method and a powder metallurgical method. In a high speed tool steel billet which is manufactured by casting, coarse carbides are formed during the casting, and these coarse carbides are non-uniformly distributed within the billet, with the result that the workability becomes bad, and that the toughness and the shock resistance become low. Further, due to the growth of the coarse carbides and the severe segregation of the microstructure, the kinds and contents of the alloy elements to be added are limited, this being a further disadvantage.

On the other hand, in the case where the high speed tool steel is manufactured by applying the powder metallurgical method, fine and uniform carbides can be obtained owing to the rapid cooling. Further, the amount of the alloy elements can be increased, and therefore, a material having a high abrasion resistance can be obtained.

For example, Japanese Patent Application Laid-open No. Sho-55-38961 discloses a method for manufacturing a high speed tool steel in which the powder metallurgical method is applied while restricting the content of tungsten. In this method, the growth of the $M_2C$ carbide is inhibited, and instead, the growth of the MC and $M_6C$ carbides are promoted, with the result that toughness and abrasion resistance are improved.

However, when manufacturing the high speed tool steel by applying the powder metallurgical method, there is required a complicated manufacturing process including the preparation of powder, a particle size sorting, a canning, a degassing treatment, a preform-making process, and a sintering process. Therefore, the control of the manufacturing conditions is difficult, and therefore, the manufacturing cost is increased.

Further, the $M_6C$ carbides form carbide cells on the grain boundaries within the powder, and the carbide cells grow during the high temperature sintering so as to form continuous carbide cells. If these are to be destroyed, a high forging ratio is required. Further, in a coarse powder, there are generated the growth of coarse $M_6C$ carbides and a segregation phenomenon, and therefore, toughness is adversely affected. Therefore, the control of particle size becomes difficult.

Meanwhile, the present applicant filed a patent application (under Korean Patent Application No. 94-38977) in which a method for manufacturing a high speed tool steel by applying a spray forming is disclosed unlike the casting and the powder metallurgical methods.

In this spray forming method, the MC+$M_2C$ carbides are formed, and then, the $M_2C$ carbides are made to be thermally decomposed. Then a hot forging is carried out. This spray forming method has many process advantages compared with the conventional casting and powder metallurgical methods. However, this spray forming method shows severe segregations, and therefore, it is applied to a particular composition, while it has not been commercialized.

SUMMARY OF THE INVENTION

The present invention is intended to overcome the above described disadvantages of the conventional techniques.

Therefore it is an object of the present invention to provide an Fe—C—V—W—Mo—Cr—Co high speed tool steel in which segregations are inhibited unlike the conventional methods, so that it would be suitable for the spray forming method, and that a high toughness and a high abrasion resistance can be obtained.

It is another object of the present invention to provide a method for manufacturing a high speed tool steel, in which a spray casting method is applied, thereby obtaining a high toughness and a high abrasion resistance.

It is still another object of the present invention to provided a method for manufacturing a high speed tool steel, in which the spray casting method is applied, and in which MC and $M_2C$ carbide structures are grown in the bulk material obtained from the melt, and a thermal decomposition is carried out, thereby obtaining a high speed tool steel containing finally stabilized MC and $M_6C$ carbides in a uniform manner.

It is still another object of the present invention to provided a method for manufacturing a high speed tool steel, in which the spray casting method is applied, and in which the formation of the stabilized carbides can be easily controlled.

In achieving the above objects, the high speed tool steel according to the present invention includes a basic composition of $W_aMo_bCr_cCo_dV_xFe_z$ where the subscripts meet in weight %: $5.0\% \leqq a \leqq 7.0\%$, $4.0\% \leqq b \leqq 6.0\%$, $3.0\% \leqq c \leqq 5.0\%$, $6.5\% \leqq d \leqq 9.5\%$, $2.2\% \leqq x \leqq 8.3\%$, $1.1\% \leqq y \leqq 2.18\%$, and $66.52\% \leqq z \leqq 73.7\%$; a final structure having carbides uniformly distributed within a martensite matrix; and main ingredients of said carbides being MC and $M_6C$.

In another aspect of the present invention, the method for manufacturing a high speed tool steel by applying a spray casting method according to the present invention includes the steps of: melting an alloy having a basic composition of $W_aMo_bCr_cCo_dV_xC_yFe_z$ where the subscripts meet in weight %: $5.0\% \leqq a \leqq 7.0\%$, $4.0\% \leqq b \leqq 6.0\%$, $3.0\% \leqq c \leqq 5.0\%$, $6.5\% \leqq d \leqq 9.5\%$, $2.2\% \leqq x \leqq 8.3\%$, $1.1\% \leqq y \leqq 2.18\%$, and $66.52\% \leqq z \leqq 73.7\%$, so as to form a melt; making a bulk material from said melt by applying a gas-spraying process; carrying out a heat treatment for decomposition on said bulk material; and carrying out a hot working.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
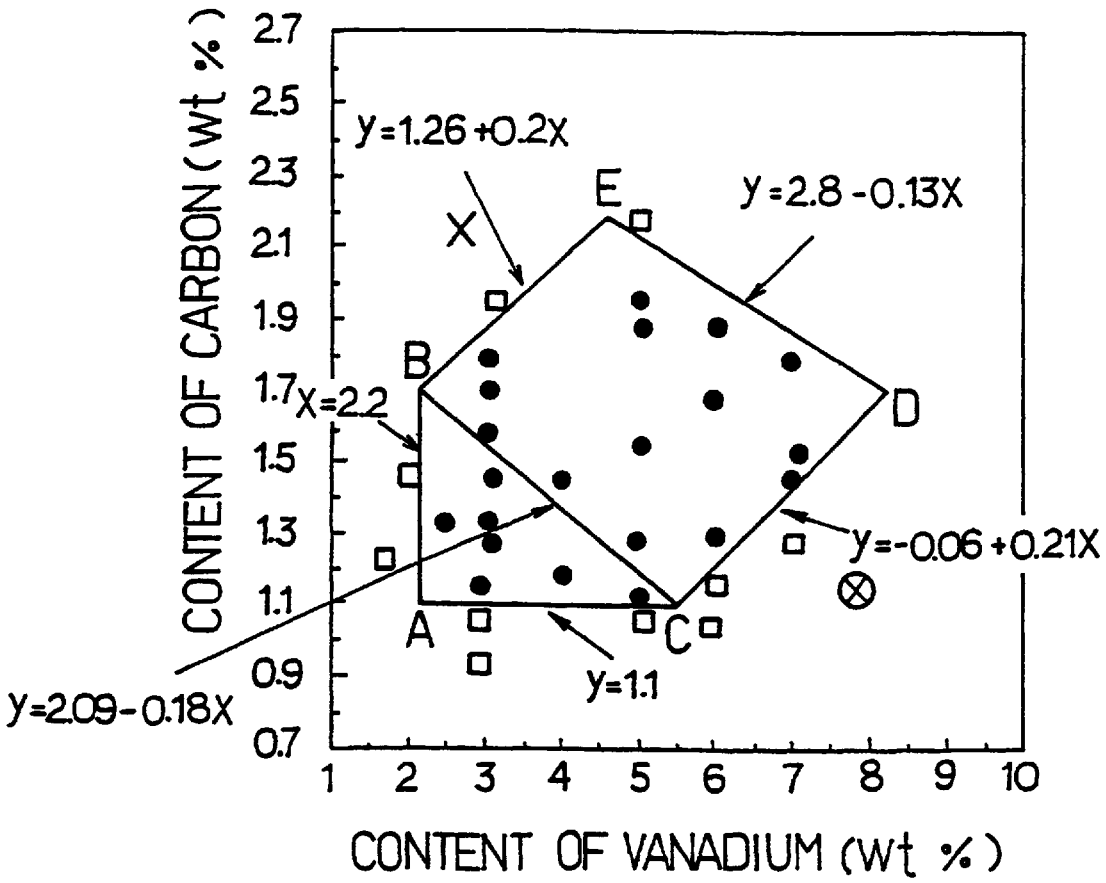
FIG. 1 is a graphical illustration showing carbon versus vanadium in the alloy of the present invention and a comparative alloy.

The present invention provides an Fe—C—V—W—Mo—Cr—Co high speed tool steel. The high speed tool steel according to the present invention includes a basic composition of $W_aMo_bCr_cCo_dV_xC_yFe_z$. Controls are made in such a manner that the final structure should have carbides uniformly distributed within a martensite matrix, and that segregations should be prevented. For this purpose, the above subscripts meet in weight %: $5.0\% \leqq a \leqq 7.0\%$, $4.0\% \leqq b \leqq 6.0\%$, $3.0\% \leqq c \leqq 5.0\%$. $6.5\% \leqq d \leqq 9.5\%$, $2.2\% \leqq x \leqq 8.3\%$, $1.1\% \leqq y \leqq 2.18\%$, and $66.52\% \leqq z \leqq 73.7\%$.

Specifically, tungsten and molybdenum are typical carbide forming elements in the high speed tool steel. If their contents are maintained at 6.0±1.0 wt % and 5.0±1.0 wt % respectively, then acceptable levels of the mechanical properties can be obtained.

Chrome and cobalt give a hardening effect to the high speed tool steel, and improve its hardness. If their contents are maintained at 4.0±1.0 wt % and 8.0±1.5 wt % respectively, then acceptable levels of the mechanical properties can be obtained.

Vanadium is an alloy element which is observed in MC, $M_6C$ and $M_2C$ carbides, but the amounts of vanadium included in the respective carbides are different from each other. That is, the MC carbide contains the largest amount of vanadium, the next is the $M_2C$ carbide, and the least amount of vanadium is contained in the $M_6C$ carbide.

Therefore, in accordance with the content of vanadium, the carbides to be formed are decided. Specifically, if the addition amount of vanadium is less than 2.2 wt %, the growth of $M_2C$ carbide is inhibited, and somewhat coarse MC and $M_6C$ carbides are grown. These carbides are uncontrollable during the heat treatment, and after a hot working, the carbides are not fine and not uniformly distributed, thereby lowering the toughness.

On the other hand, if vanadium is added more than 8.3 wt %, then the MC carbide is formed in a large amount so as to deplete the residual carbon amount within the melt. Consequently, the formation of the $M_2C$ carbide is inhibited, and the MC carbide is grown into a coarse form, with the result that the final mechanical properties are aggravated.

Therefore, the content of vanadium should be preferably maintained at 2.2–8.3 wt %. For the formation of more uniform carbides, the content of vanadium should be preferably maintained at more than 4.0 wt % and less than 8.0 wt %.

If the carbon content is insufficient, the cast structure after the spray casting becomes not the $MC+M_2C$ carbide structure but the $MC+M_6C$ carbide cells, with the result that the final structure cannot be formed into the $MC+M_6C$ carbide structure.

On the other hand, if the carbon content is excessive, then a large amount of coarse primary MC carbide is formed during the solidification. Further, due to the formation of the MC carbide, the amount of vanadium is exhausted, and consequently, the formation of the $M_2C$ carbide is inhibited. As a result, the toughness and the abrasion resistance of the steel are lowered.

Therefore, basically the carbon content should be preferably maintained at 1.1–2.1 wt %.

Meanwhile, the optimum carbon content should be decided in accordance with the carbide forming elements contained in the high speed tool steel, so that the high speed tool steel would be suitable for the spray casting method. That is, the carbon content is decided in accordance with which one of $M_2C$ and $M_6C$ becomes the main ingredient. If the high speed tool steel is to be made suitable for the spray casting, the $M_6C$ carbide which has a stable phase should be inhibited, and the $M_2C$ carbide which has a meta stable phase should be promoted. Therefore, The carbon content is decided in such a manner that the $M_2C$ carbide of the meta stable phase as the eutectic carbide within the spray cast structure should become the main ingredient.

For this purpose, in the high speed tool steel of the present invention, the relationship between the content of carbon and that of vanadium is important.

FIG. 1 is a graphical illustration showing carbon versus vanadium in the alloy of the present invention and a comparative alloy.

That is, even if a sufficient amount of carbon is added, if vanadium is insufficient (as shown by the X mark in FIG. 1), then the primary MC carbide is excessively formed, with the result that vanadium is exhausted in the melt, and that the formation of the $M_2C$ carbide is inhibited. Further, in the case where too much vanadium is added, if carbon is insufficient (as shown by the (X) mark in FIG. 1), then a delta (δ) ferrite is formed, with the result that the hardening capability is lowered.

Considering such a relationship between carbon and vanadium, the contents of carbon and vanadium should come within the following ranges as shown in FIG. 1. That is, the ranges are $x \geqq 2.2$, $y \geqq 1.1$, $y \geqq -0.06+0.21x$, $y \leqq 2.8-0.13x$, and $y \leqq 1.26+0.2x$ (the A-B-E-D-C region of FIG. 1). More preferably, the contents of carbon and vanadium should come within the ranges of $y \geqq 2.09-0.18x$, $y \geqq 0.06+0.21x$, $y \leqq 2.8-0.13x$ and $y \leqq 1.26+0.2x$ (the B-C-D-E region of FIG. 1).

The final structure of the high speed tool steel according to the present invention thus composed is converted into a martensite matrix through a hardening treatment. Within the matrix, there are formed MC and $M_6C$ carbides. The size of the carbides is about 3 μm, and the carbides are very much uniformly distributed.

Now the method for manufacturing the high speed tool steel according to the present invention will be described.

The spray casting according to the present invention is carried out in the following manner. That is, a melt within a tundish is sprayed by means of a gas jet so as to make the sprayed melt collided with a substrate. In this manner, a liquid state of about 50–70% is maintained, and a bulk material having the form of billet or the like is produced.

When the spray casting process of the present invention is applied to the high speed tool steel, first the composition of the melt is adjusted to the ranges described above.

Thus, the melt which is composed as described above is sprayed into a certain mold by the help of the gas jet, and the spray-cast bulk material thus formed is made to have the MC and $M_2C$ carbide structures. Then a heat treatment for decomposition into MC and $M_6C$ is carried out, and then, a hot working is carried out to make the fine final carbides distributed in a uniform manner.

The formations of the MC, $M_2C$ and $M_6C$ carbides which are observed in the high speed tool steel of $W_aMo_bCr_cCo_dV_xC_yFe_z$ after its manufacture as described above are closely related not only to the alloy composition but also to the total amount of heat introduced into the bulk material. The typical process condition which is related to the introduced heat is the temperature of the melt.

When the melt temperature is too low, the carbides of the spray cast microstructure are $MC+M_6C$ and the yield efficiency of the process also are reduced because a lot of impinging colder droplets tend to bounce off without deposition. On the contrary, when the melt temperature is too high, the ejection of liquid surface on the top of bulk materials(growing billets) occurs by external forces due to substrate rotation and impingement of the gas jet, resulting in significantly low yield efficiency. In addition, higher melt temperatures cause colony of coarser $MC+M_2C$ carbides which is similar to that obtained by the conventional ingot casting and thus good mechanical properties cannot be expected. Therefore, there should be a melt temperature range at which $MC+M_2C$ carbides are formed without sacrificing the yield efficiency during spray casting.

Accordingly, if the carbides of the spray cast structure are to be controlled into the $MC+M_2C$ carbides, the temperature of the melt has to be controlled. In the present invention, the temperature of the melt immediately before the spraying should be maintained higher than the liquidus line temperature preferably by 130–290° C.

In the present invention, the liquidus line temperature of the high speed tool steel of $W_aMo_bCr_cCo_dV_xC_yFe_z$ can be calculated based on the following definition.

$$\text{Liquidus line temperature (° C.)}=1536-\{0.1+83.9[\%C]+10[\%C]^2+1.5[\%Cr]+3.3[\%Mo]-2[\%V]\} \quad (1)$$

where all the contents of the elements are shown in weight %.

The temperature of the melt is controlled in this manner, and then, the spraying is carried out. Under this condition, the spraying conditions are the usually practiced ones. For example, the desirable spraying conditions are as follows. That is, the melt orifice diameter of the tundish is decided to be 3–9 mm, and the melt droplet flight distance is decided to be 400–700 mm. The primary gas pressure and the secondary gas pressure of the gas nozzles are decided to be 1.5–4.5 bars and 5–10 bars respectively, and the scanning frequency of the respective nozzles is decided to be 12–18 cycles/sec.

In the spray cast alloy such as the billet which is obtained through the above described spray conditions, there are contained $MC+M_2C$ carbides. The $M_2C$ carbide begins to be decomposed near 900° C., but if it is to be decomposed suitably for a hot fabricating process, either the maintaining time has to be extended or the decomposing temperature has to be raised. However, in the range of 900–1000° C., several scores of hours of maintaining time is required, and this gives an inefficiency commercially. Meanwhile, at a temperature exceeding 1200° C., the carbide is abnormally grown or redissolved, thereby rather inviting the lowering of the toughness.

The temperature of the carbide decomposing heat treatment which is suitable for the manufacture of the $W_aMo_bCr_cCo_dV_xC_yFe_z$ high speed tool steel should be preferably limited to 1000–1200° C. Specifically, if the temperatures of the decomposing heat treatment are 1000° C., 1050° C., 1100° C., 1150° C. and 1200° C., then the suitable maintaining time periods are 16, 8, 4, 2 and 1 hours.

The bulk material which has been thermally decomposed after being spray-cast has to be made to undergo a hot working, so that the structure of the carbides would become finer.

The hot working which is carried out in the present invention may be any one of hot forging, hot rolling, and hot extrusion. The important thing is to maintain the hot working temperature at 950–1150° C. Due to a contact between the worked material and the die during the hot working, the temperature of the surface of the material greatly drops below the internal temperature, with the result that there occurs a difference of the plasticity between the surface and the internal region. If the hot working temperature exceeds 1150° C., the difference is significantly increased, resulting in that severe cracks are formed on the surface and edges of the material.

Meanwhile, if the temperature of the material is below 950° C., an insufficiency of the plasticity occurs due to the increase in the deformation resistance of the material, and therefore, an efficient hot working becomes impossible. Under this condition, if an excessive load is imposed, then cracks are formed on the material. Accordingly, the hot working temperature should be maintained at the above mentioned level.

In the case where the hot forging is used, if the carbides are to be uniformly distributed, the forging ratio needs to be 6 or more.

In the case of the hot rolling, the reduction ratio should be 80% or more, while in the case of the hot extrusion, the extrusion ratio should be 10:1 or more. Then the resultant effect will be almost the same.

After the hot working, an austenizing treatment is carried out, and a hardening treatment in the form of a tempering is carried out. Then the structure of the matrix can be converted into a martensite.

If the above described melt temperature conditions for the $W_aMo_bCr_cCo_dV_xC_yFe_z$ high speed tool steel are properly controlled during the spray casting, then the carbide structures are made to contain only MC and $M_2C$. Then if they are properly made to undergo a heat treatment for decomposition, and if a hot working is carried out, then there can be obtained a high toughness and high abrasion resistance $W_aMo_bCr_cCo_dV_xC_yFe_z$ high speed tool steel in which fine MC carbides and fine $M_6C$ carbides are uniformly distributed.

Now the present invention will be described based on actual examples.

EXAMPLE 1

Alloy systems were prepared which were composed of in weight 6.0% of W, 5.0% of Mo, 4.0% of Cr and 8.0% of Co, carbon and vanadium being contained as shown in Table 1 below. Then the alloys were melted in an induction furnace under the external atmosphere, and billets were manufactured by using a spray casting apparatus. As to the melt temperature, first the liquidus line temperature was calculated based on Formula 1, and then, the actual temperatures were maintained at levels higher than the liquidus line by 130–290° C. The respective alloys thus manufactured were subjected to heat treatments at a temperature of 1200° C. for 1 hour. Then they were hot-forged with a forging ratio of 6 or more. Then they were made to undergo hardening heat treatments, and then, the mechanical properties were measured, the measured results being shown in Table 1 below. The hardening heat treatments were carried out in such a manner that first the alloys were all austenized at a temperature of 1180° C., then were oil-quenched, and then, were tempered 3 times for one hour each time at a temperature of 560° C.

The alloys which have undergone the hardening heat treatments were evaluated as to their hardness, their bend strength, and their abrasion resistance. In measuring the hardness, first test specimens of 20×20×20 (mm) were prepared, and then a Rockwell hardness tester (C scale, diamond indenter, 150 Kgf) was used. In measuring the bend strength, test specimens of 6.35×6.35×40.68 (mm) were prepared, and then, 3-point bend tests were carried out at a speed of 0.5 mm/min. In evaluating the abrasion resistance, test pieces of 30×30×5 (mm) were prepared, and then, tests were carried out with a load of 100 Kgf by using the SKD61 alloy as the counter part material.

In Table 1 below, the conventional materials are the M2 and ASP30 casting alloys and the ASP30 powder metallurgical alloy. That is, the conventional examples 1 and 2 were the M2 (6%W-5%Mo-4%Cr-2%V-0.85%C) and ASP (6.4%W-5%Mo-4.2%Cr-8.5%Co-3.1%V-1.3%C) high speed tool steels which were manufactured by the ordinary casting method, and they had a composition similar to that of the present invention. The conventional example 3 was a high speed tool steel which was manufactured by the powder metallurgical method, and which was an ASP alloy having the above indicated composition. They were all made to undergo the hot workings and the hardening treatments in the same manner as that of the present invention, and the mechanical properties were measured in the same way.

TABLE 1

| test | alloy composition (wt %) | | | liquidus | melt temperature | hardness/ | bending strength | abrasion resistance (load decrease)/ |
|---|---|---|---|---|---|---|---|---|
| piece No. | V | C | Fe | line (° C.) | (° C.) | (HRc) | (GPa) | (mg/km) |
| comparative example 1 | 1.7 | 1.22 | bal. | 1392.8 | 1602.8 ± 80 | 63.2 | 2.41 | 87.7 |
| comparative example 2 | 2.1 | 1.45 | bal. | 1366.5 | 1576.5 ± 80 | 64.1 | 2.09 | 86.8 |
| comparative example 3 | 2.9 | 0.92 | bal. | 1421.9 | 1631.9 ± 80 | 63.6 | 2.73 | 79.4 |
| comparative example 4 | 2.9 | 1.05 | bal. | 1408.5 | 1618.5 ± 80 | 62.8 | 2.57 | 90.0 |
| comparative example 5 | 3.3 | 1.95 | bal. | 1305.2 | 1515.2 ± 80 | 64.2 | 2.13 | 84.3 |
| comparative example 6 | 5.1 | 1.02 | bal. | 1407.2 | 1617.2 ± 80 | 64.2 | 2.91 | 87.8 |
| comparative example 7 | 5.0 | 2.15 | bal. | 1274.8 | 1484.8 ± 80 | 66.8 | 1.75 | 52.4 |
| comparative example 8 | 5.9 | 1.01 | bal. | 1406.7 | 1616.7 ± 80 | 64.3 | 2.01 | 56.3 |
| comparative example 9 | 6.1 | 1.15 | bal. | 1391.5 | 1601.5 ± 80 | 64.5 | 1.88 | 50.5 |
| comparative example 10 | 7.1 | 1.29 | bal. | 1375.4 | 1585.4 ± 80 | 64.7 | 1.62 | 53.2 |
| inventive example 1 | 2.5 | 1.32 | bal. | 1380.2 | 1590.2 ± 80 | 66.3 | 4.47 | 83.5 |
| inventive example 2 | 2.9 | 1.14 | bal. | 1399.0 | 1609.0 ± 80 | 65.8 | 4.68 | 58.2 |
| inventive example 3 | 3.1 | 1.26 | bal. | 1385.5 | 1595.5 ± 80 | 66.5 | 4.67 | 56.5 |
| inventive example 4 | 3.0 | 1.31 | bal. | 1380.3 | 1590.3 ± 80 | 66.9 | 4.60 | 54.9 |
| inventive example 5 | 3.2 | 1.45 | bal. | 1364.3 | 1574.3 ± 80 | 67.7 | 4.50 | 53.4 |
| inventive example 6 | 3.1 | 1.57 | bal. | 1350.8 | 1560.8 ± 80 | 68.4 | 4.55 | 52.1 |
| inventive example 7 | 3.1 | 1.69 | bal. | 1336.8 | 1546.8 ± 80 | 65.6 | 4.58 | 73.4 |
| inventive example 8 | 3.1 | 1.77 | bal. | 1327.4 | 1537.4 ± 80 | 66.0 | 4.62 | 69.5 |
| inventive example 9 | 4.0 | 1.24 | bal. | 1386.0 | 1596.0 ± 80 | 67.5 | 4.71 | 53.0 |
| inventive example 10 | 4.1 | 1.45 | bal. | 1362.5 | 1572.5 ± 80 | 69.0 | 4.63 | 52.1 |
| inventive example 11 | 5.0 | 1.12 | bal. | 1396.9 | 1606.9 ± 80 | 67.1 | 4.81 | 44.5 |
| inventive example 12 | 4.9 | 1.28 | bal. | 1379.8 | 1589.8 ± 80 | 68.4 | 4.70 | 41.8 |

TABLE 1-continued

| test piece No. | alloy composition (wt %) V | C | Fe | liquidus line (° C.) | melt temperature (° C.) | hardness/ (HRc) | bending strength (GPa) | abrasion resistance (load decrease)/ (mg/km) |
|---|---|---|---|---|---|---|---|---|
| inventive example 13 | 5.1 | 1.53 | bal. | 1351.4 | 1561.4 ± 80 | 68.8 | 4.72 | 40.4 |
| inventive example 14 | 5.1 | 1.84 | bal. | 1315.0 | 1525.0 ± 80 | 69.5 | 4.60 | 39.0 |
| inventive example 15 | 6.0 | 1.92 | bal. | 1305.4 | 1515.4 ± 80 | 70.7 | 4.63 | 37.5 |
| inventive example 16 | 6.0 | 1.29 | bal. | 1376.5 | 1586.5 ± 80 | 68.0 | 4.75 | 45.5 |
| inventive example 17 | 5.9 | 1.67 | bal. | 1333.6 | 1543.6 ± 80 | 71.6 | 4.61 | 39.4 |
| inventive example 18 | 6.1 | 1.88 | bal. | 1308.1 | 1518.1 ± 80 | 72.8 | 4.35 | 36.5 |
| inventive example 19 | 7.1 | 1.43 | bal. | 1358.8 | 1568.8 ± 80 | 69.3 | 4.54 | 38.4 |
| inventive example 20 | 7.2 | 1.51 | bal. | 1349.5 | 1559.5 ± 80 | 71.3 | 4.42 | 40.6 |
| inventive example 21 | 7.2 | 1.73 | bal. | 1323.9 | 1533.9 ± 80 | 72.5 | 4.10 | 39.5 |
| conventional example 1 | 2.0 | 0.85 | bal. | M2 alloy made by ordinary casting method | | 65.8 | 3.12 | 109.0 |
| conventional example 2 | 3.1 | 1.3 | bal. | ASP30 alloy made by ordinary casting method | | 67.5 | 2.33 | 83.5 |
| conventional example 3 | 3.1 | 1.3 | bal. | ASP30 alloy made by ordinary powder metallurgical method | | 68.5 | 4.70 | 55 |

As shown in Table 1 above, in the cases of the inventive examples 1–21 which were manufactured according to the present invention, the overall mechanical properties were superior compared with the comparative examples 1–10. Particularly, when the inventive examples were compared with the cast materials of the conventional examples 1 and 2, the hardness was similar to each other, but the bending strength and the abrasion resistance of the inventive examples were more than twice those of the conventional examples 1 and 2. Meanwhile, when the inventive examples were compared with the conventional example 3 which was manufactured by the usual powder metallurgical method, the hardness and the bending strength were similar to each other, but the abrasion resistance of the present invention was superior over that of the conventional example 3.

Figure 2A:
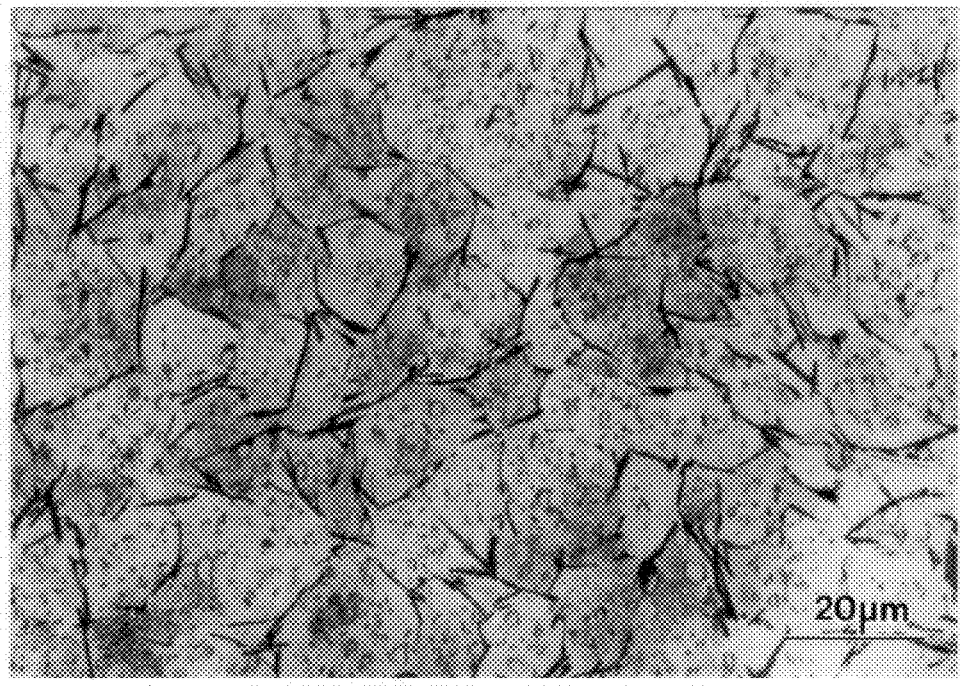
FIG. 2 is a photograph showing the billet casting structure of the alloy of the present invention and the comparative alloy.
Figure 2B:
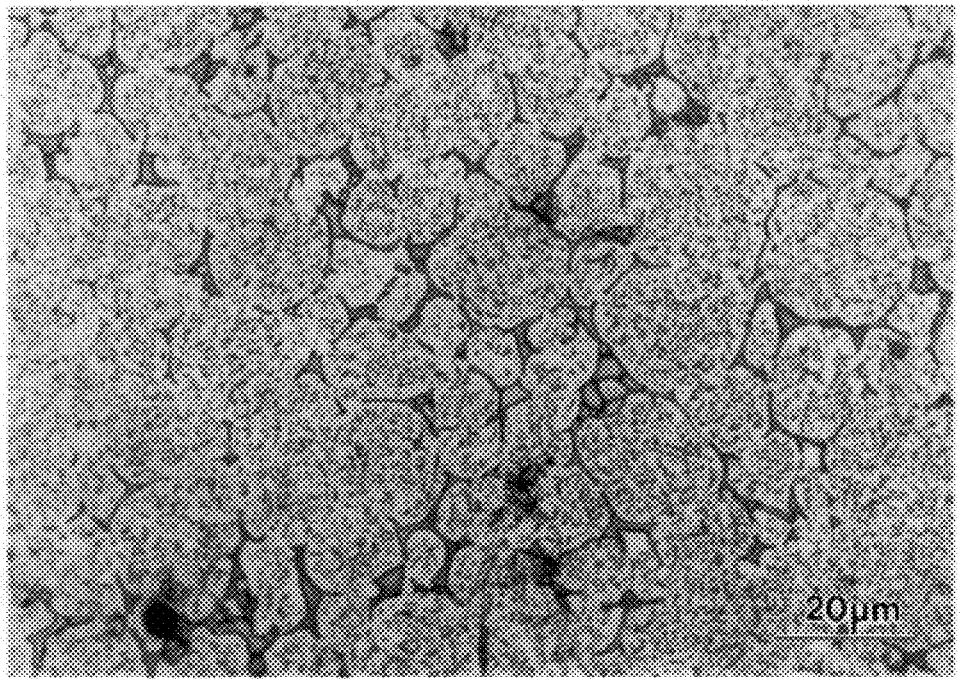

Meanwhile, the casting structures of the billets were observed, and the typical structure is illustrated in FIG. 2. The spray-cast structures of the billets showed two types of carbide structures. The first was the MC+$M_2C$ carbide structures as shown in FIG. 2A. That is, they were carbide cells composed of the spherical MC carbides and the rod shaped $M_2C$ carbides (inventive examples). The second was the MC+$M_6C$ carbide structures as shown in FIG. 2B. That is, they were carbide cells composed of the spherical MC carbides and the spherical $M_6C$ carbides (comparative examples).

FIG. 1 corresponds to the alloys of Table 1. That is, it illustrates the alloys of the inventive examples having the casting structure of MC+$M_2C$ and the alloys of the comparative examples having the structure of MC+$M_6C$ in accordance with the contents of carbon and vanadium.

As shown in FIG. 1, the internal region of the polygon illustrates the region of the present invention in which the spray-cast structure is the MC+$M_2C$ carbides. The outer region illustrates the region of the comparative examples in which the spray-cast structure is the MC+$M_6C$ carbides. Here, it can be known that the high speed tool steel of the present invention first has to have a casting structure of the MC+$M_2C$ carbides. After all, here it has been confirmed that the relationship between the carbon ingredient y and the vanadium ingredient x should be as follows. That is, $x \geqq 2.2$, $y \geqq 1.1$, $y \geqq 0.06+0.21x$, $y \leqq 2.8-0.13x$ and $y \leqq 1.26+0.2x$ have to be satisfied.

Further during the heat treatment for decomposition of the carbides, if fine carbides are to be grown, then x and y should preferably satisfy the relationships of $y \geqq 2.09-0.18x$, $y \geqq -0.06+0.21x$, $y \leqq 2.8-0.13x$, $y \leqq 1.26+0.2x$.

Figure 3:
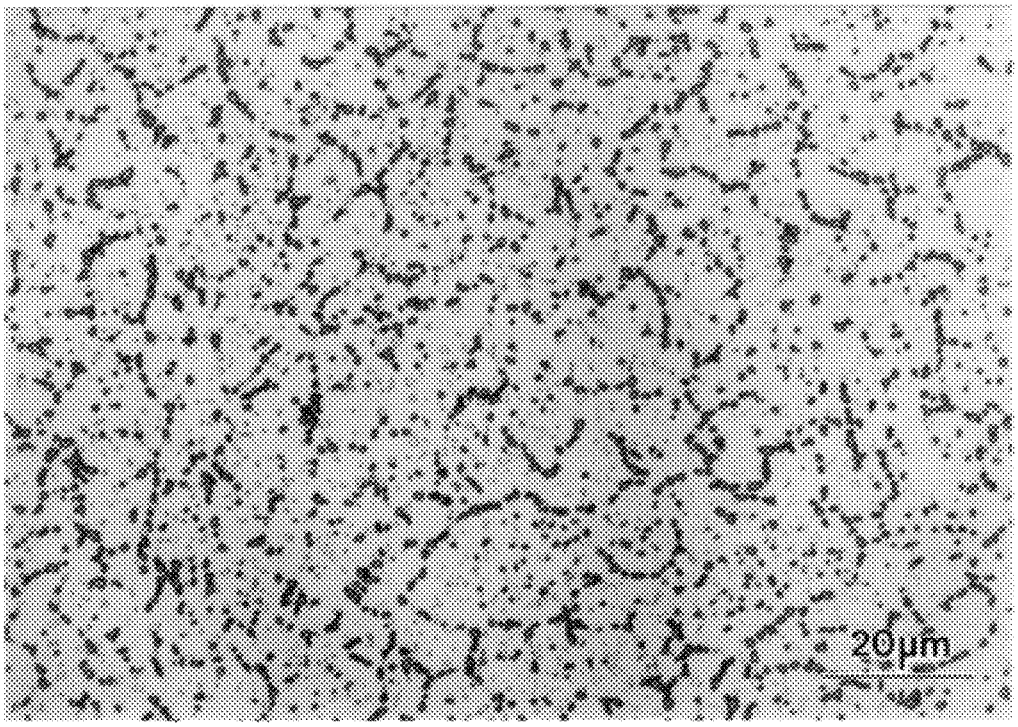
FIG. 3 is a photograph showing the carbide structure of the alloy of the present invention after carrying out a heat treatment for decomposition.

FIG. 3 illustrates the micro-structure of the $M_2C$ carbides of the inventive example 11 after the heat treatment for decomposition. By the heat treatment for decomposition, the rod shaped $M_2C$ carbides were decomposed into the MC carbides and the $M_6C$ carbides of less than 2 $\mu$m. On the other hand, in the case of the comparative examples, they had the MC+$M_6C$ carbide structures, and the carbide structures were not decomposed even with the heat treatment of decomposition.

Figure 4A:
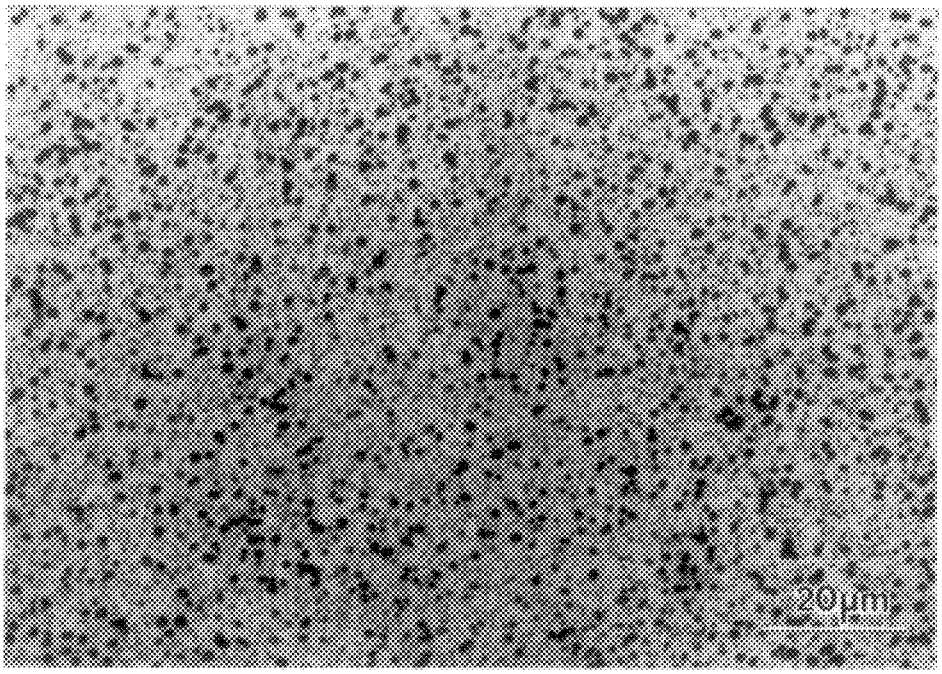
FIG. 4 illustrates a case in which the alloy of FIG. 2 is hot-worked.
Figure 4B:
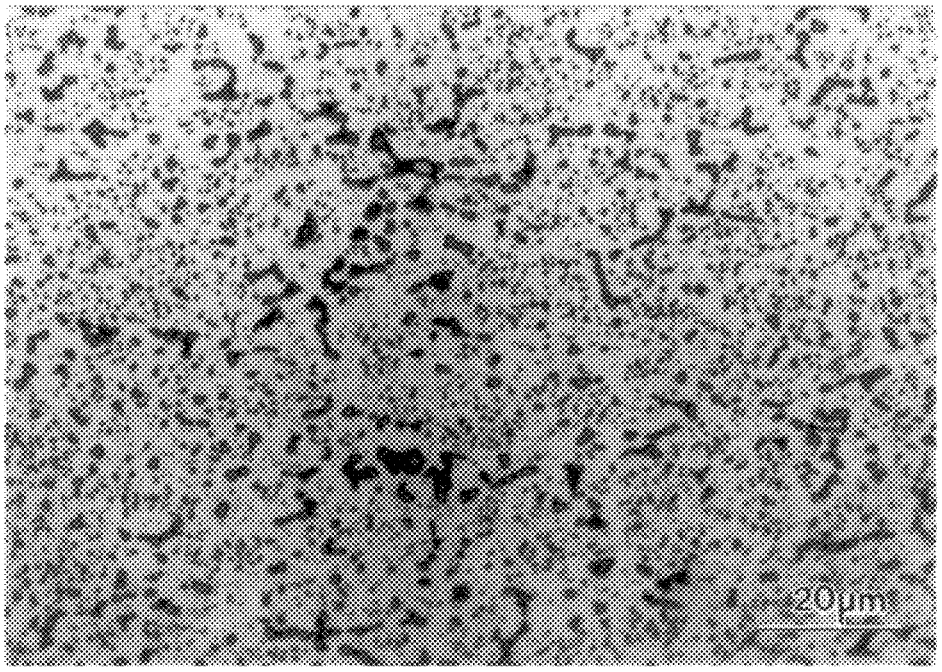

FIG. 4 illustrates the case in which the billets of FIG. 2 were hot-worked after carrying out a decomposing heat treatment. FIG. 4A illustrates a micro-structure after hot-working the material of FIG. 2A, while FIG. 4B illustrates a micro-structure after hot-working the material of FIG. 2B.

As shown in FIG. 4A, the alloys of the present invention showed micro-structures in which the spherical fine MC and $M_6C$ carbides were uniformly distributed. On the contrary, as shown in FIG. 4B, the comparative alloys were irregular in the size and distribution of the carbides.

EXAMPLE 2

An alloy which has the composition of the inventive example 10 was formed into billets in the same manner as that of Example 1, except that the melt temperature was 1460° C., this being lower than the melt temperature of Table 1. The structure of the billet thus manufactured is shown in FIG. 5 (comparative example 11).

Figure 5:
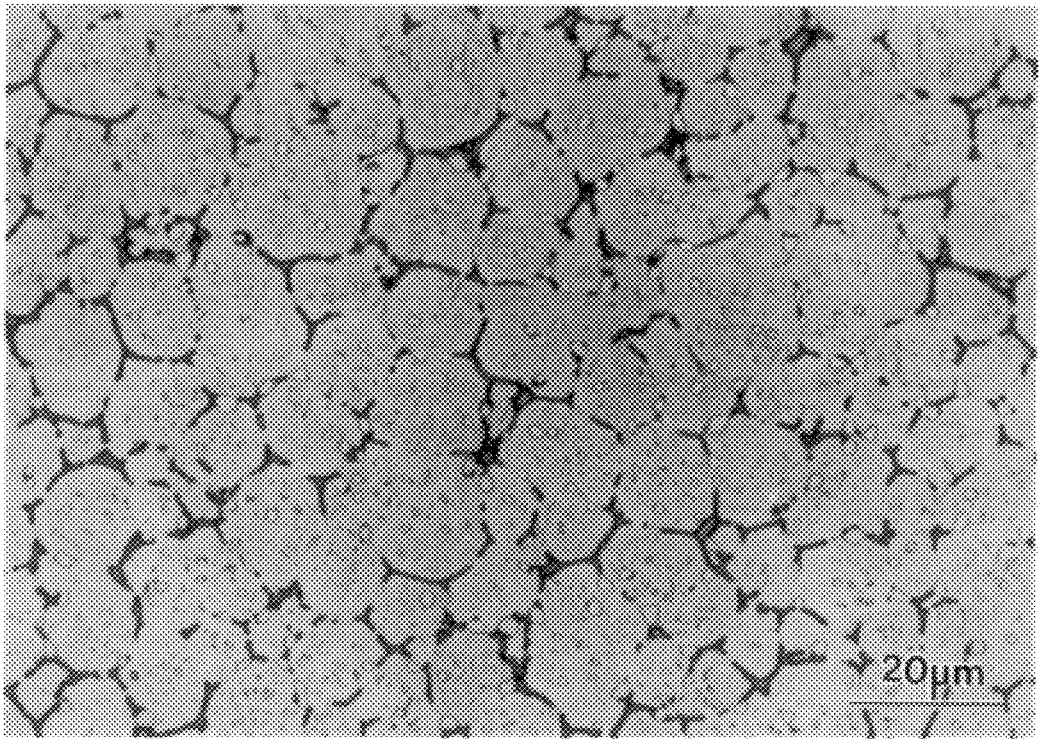
FIG. 5 is a photograph showing the casting structure of a billet which has been spray-cast at a low temperature.

As shown in FIG. 5, in the case of the comparative example 11 which was manufactured at a temperature lower than that of the present invention, the carbide structure was composed of carbide cells of the MC carbides and the $M_6C$ carbides. Such a carbide structure includes coarse $M_6C$ carbides non-uniformly distributed even after the hot working.

Actually, when this alloy was hot-worked, the properties were a hardness of 63.4 HRc, a bending strength of 2.24 GPa and an abrasion resistance of 90.1 mg/Km. That is, when the melt temperature was lower than that of the present invention, the uniform structure which was seen in the present invention could not be obtained with any conditions of heat treatment and hot working, but the toughness and the abrasion resistance were markedly aggravated. Consequently, it was confirmed that the melt temperature was important in manufacturing the high speed tool steel of the present invention.

EXAMPLE 3

Billets were manufactured in the same way as that of Example 1, except that the alloy composition was in weight %: 6.5% of W, 5.0% of Mo, 4% of Cr, 3.1% of V, 8% of Co, and a balance of Fe, in addition to 1.42% of C (inventive example 22), and 1.05% of C (comparative example 12). The billets were manufactured by using a spray-casting apparatus, and then, their mechanical properties were measured.

In the case of the inventive example 22, the evaluation of the mechanical properties showed a hardness of 67.2 HRc, a bending strength of 4.47 GPa, and an abrasion resistance of 55.0 mg/Km. In the case of the comparative example 12, the evaluation showed a hardness of 63.1 HRc, a bending strength of 2.69 GPa and an abrasion resistance of 94.2 mg/Km. That is, the inventive example 22 showed to be superior over the comparative example 12 in all the mechanical properties.

According to the present invention as described above, there is provided a high toughness and high abrasion resistance $W_aMo_bCr_cCo_dV_xC_yFe_z$ high speed tool steel in which fine carbides are uniformly distributed. Particularly, this high speed tool steel can be manufactured by the spray casting method at a cheap cost compared with the conventional casting and/or powder metallurgical method. Thus, the conventional high prestige high speed tool steel component which could be obtained by using only the expensive powder metallurgical material can be substituted by a cheap material having the same mechanical properties. At the same time, the application of the high performance high speed tool steel can be widened.

What is claimed is:

1. A method for manufacturing a high speed tool steel by applying a spray casting method, comprising the steps of:

melting an alloy having a basic composition consisting essentially of $W_aMo_bCr_cCo_dV_xC_yFe_z$ where the subscripts meet in weight %: $5.0\% \leqq a \leqq 7.0\%$, $4.0\% \leqq b \leqq 6.0\%$, $3.0\% \leqq c \leqq 5.0\%$, $6.5\% \leqq d \leqq 9.5\%$, $2.2\% \leqq x \leqq 8.3\%$, $1.1\% \leqq y \leqq 2.18\%$, and $66.52\% \leqq z \leqq 73.7\%$, wherein x and y come within ranges of $x \geqq 2.2$, $y \geqq 1.1$, $y \geqq -0.06+0.21x$, $y \leqq 2.8-0.13x$, and $y \leqq 1.26+0.2x$ so as to form a molten alloy;

gas-spraying said molten alloy to form a bulk material having MC and $M_2C$ carbide structures therein and, wherein said molten alloy is maintained at a temperature of 130° C. to 290° C. above a liquidus line temperature immediately before said gas-spraying;

heat treating said bulk material to decompose the $M_2C$ carbide structures in the bulk material to obtain stabilized MC and $M_6C$ carbide structures in the bulk material; and hot working the heat treated bulk material to a desired shape.

2. The method as claimed in claim 1, wherein x and y come within ranges of $y \geqq 2.09-0.18x$, $y \geqq 0.06+0.21x$, $y \leqq 2.8-0.13x$ and $y \leqq 1.26+0.2x$.

3. The method as claimed in claim 1, wherein said heat treatment for decomposition of the $M_2C$ carbide structures is carried out at a temperature of 1000–1200° C. for 1–16 hours.

4. The method as claimed in claim 1, wherein said hot working is carried out at a temperature of 950–1150° C.

5. The method as claimed in claim 4, wherein said hot working is carried out with a forging ratio of 6 or more.

6. The method as claimed in claim 4, wherein said hot working is carried out at a reduction ratio of 80% or more.

7. The method as claimed in claim 4, wherein said hot working is carried out at an extrusion ratio of 10:1 or more.

* * * * *

UNITED STATES PATENT AND TRADEMARK OFFICE

CERTIFICATE OF CORRECTION

PATENT NO. : 5,976,277

DATED : November 2, 1999

INVENTOR(S) : Woo Jin Park et al.

It is certified that error appears in the above-identified patent and that said Letters Patent is hereby corrected as shown below:

Column 2 Line 58 between "$V_x$" and "$Fe_z$" insert --$C_y$--.

Signed and Sealed this

Fifth Day of December, 2000

*Attest:*

*Attesting Officer*

Q. TODD DICKINSON

*Director of Patents and Trademarks*